US005186268A

United States Patent [19]

Clegg

[11] Patent Number: 5,186,268

[45] Date of Patent: Feb. 16, 1993

[54] ROTARY DRILL BITS

[75] Inventor: John M. Clegg, Bristol, England

[73] Assignee: Camco Drilling Group Ltd.

[21] Appl. No.: 785,460

[22] Filed: Oct. 31, 1991

[51] Int. Cl.[5] ..... E21B 10/46

[52] U.S. Cl. ..... 175/399; 175/431

[58] Field of Search ..... 175/61, 320, 398, 399, 175/393, 431

[56] References Cited

U.S. PATENT DOCUMENTS

| | | | |
|---|---|---|---|
| 4,512,426 | 4/1985 | Bidegaray | 175/329 |
| 4,718,505 | 1/1988 | Fuller | 175/329 |
| 4,823,892 | 4/1989 | Fuller | 175/329 |
| 4,862,974 | 9/1989 | Warren et al. | 175/61 |
| 4,889,017 | 12/1989 | Fuller et al. | 76/108 |
| 4,905,776 | 3/1990 | Beynet et al. | 175/320 |
| 4,932,484 | 6/1990 | Warren et al. | 175/398 |
| 5,042,596 | 8/1991 | Brett et al. | 175/399 X |
| 5,099,934 | 3/1992 | Barr | 175/399 |

FOREIGN PATENT DOCUMENTS 2504589 10/1982 France .

OTHER PUBLICATIONS

"Bit Whirl—A New Theory of PDC Bit Failure", paper No. SPE 19571, by J. F. Brett, T. M. Warren and S. M. Behr, Society of Petroleum Engineers, 64th Annual Technical Conference, San Antonio, TX, Oct. 8-11, 1989.

"Development of a Whirl Resistant Bit", paper No. 19572, by T. M. Warren, Society of Petroleum Engineers, 64th Annual Technical Conference, San Antonio, TX Oct. 8-11, 1989.

*Primary Examiner*—Terry Lee Melius
*Assistant Examiner*—Frank S. Tsay

[57] ABSTRACT

A rotary drill bit comprises a bit body carrying a plurality of primary preform cutting elements defining a primary cutting profile. The bit includes means to apply a lateral imbalance force to the bit as it rotates, and a portion of the outer periphery of the bit body includes a low friction bearing surface so located as to transmit the lateral force to the formation. There are associated with some of the primary cutting elements respective secondary elements spaced inwardly of the cutting profile defined by the primary cutting elements, but the portion of the periphery of the bit body where the bearing surface is located is substantially free of such secondary elements. The arrangement enhances the anti-whirl characteristics of the bit.

16 Claims, 3 Drawing Sheets

ROTARY DRILL BITS

BACKGROUND OF THE INVENTION

The invention relates to rotary drill bits for use in drilling or coring holes in subsurface formations, and particularly to polycrystalline diamond compact (PDC) drag bits.

A rotary drill bit of the kind to which the present invention relates comprises a bit body having a shank for connection to a drill string and a passage for supplying drilling fluid to the face of the bit, which carries a plurality of preform cutting elements each formed, at least in part, from polycrystalline diamond. One common form of cutting element comprises a tablet, usually circular or part-circular, made up of a superhard table of polycrystalline diamond, providing the front Cutting face of the element, bonded to a substrate which is usually of cemented tungsten carbide.

The bit body may be machined from solid metal, usually steel, or may be moulded using a powder metallurgy process in which tungsten carbide powder is infiltrated with metal alloy binder in a furnace so as to form a hard matrix.

While such PDC bits have been very successful in drilling relatively soft formations, they have been less successful in drilling harder formations and soft formations which include harder occlusions or stringers. Although good rates of penetration are possible in harder formations, the PDC cutters suffer accelerated wear and bit life can be too short to be commercially acceptable.

Recent studies have suggested that the rapid wear of PDC bits in harder formations is due to chipping of the cutters as a result of impact loads caused by vibration, and that the most harmful vibrations can be attributed to a phenomenon called "bit whirl". ("Bit Whirl—A New Theory of PDC Bit Failure"—paper No. SPE 19571 by J. F. Brett, T. M. Warren and S. M. Behr, Society of Petroleum Engineers, 64th Annual Technical Conference, San Antonio, Oct. 8-11, 1989). Bit whirl arises when the instantaneous axis of rotation of the bit precesses around the central axis of the hole when the diameter of the hole becomes slightly larger than the diameter of the bit. When a bit begins to whirl some cutters can be moving sideways or backwards relatively to the formation and may be moving at much greater velocity than if the bit were rotating truly. Once bit whirl has been initiated, it is difficult to stop since the forces resulting from the bit whirl, such as centrifugal forces, tend to reinforce the effect.

Attempts to inhibit the initiation of bit whirl by constraining the bit to rotate truly, i.e. with the axis of rotation of the bit coincident with the central axis of the hole, have not been particularly successful.

Although it is normally considered desirable for PDC drill bits to be rotationally balanced, in practice some imbalance is tolerated. Accordingly it is fairly common for PDC drill bits to be inherently imbalanced, i.e. when the bit is being run there is, due to the cutting, hydraulic and centrifugal forces acting on the bit, a resultant force acting on the bit, the lateral component of which force, during drilling, is balanced by an equal and opposite reaction from the sides of the borehole.

This resultant lateral force is commonly referred to as the bit imbalance force and is usually represented as a percentage of the weight-on-bit since it is almost directly proportional to weight-on-bit. It has been found that certain imbalanced bits are less susceptible to bit whirl than other, more balanced bits. ("Development of a Whirl Resistant Bit"—paper No. SPE 19572 by T. M. Warren, Society of Petroleum Engineers, 64th Annual Technical Conference, San Antonio, Oct. 8--11, 1989). Investigation of this phenomenon has suggested that in such less susceptible bits the resultant lateral imbalance force is directed towards a portion of the bit gauge which happens to be free of cutters and which is therefore making lower "frictional" contact with the formation than other parts of the gauge of the bit on which face gauge cutters are mounted. It is believed that, since a comparatively low friction part of the bit is being urged against the formation by the imbalance force, slipping occurs between this part of the bit and the formation and the rotating bit therefore has less tendency to process, or "walk", around the hole, thus initiating bit whirl.

(Although, for convenience, reference is made herein to "frictional" contact between the bit gauge and formation, this expression is not intended to be limited only to rubbing contact, but should be understood to include any form of engagement between the bit gauge and formation which applies a restraining force to rotation of the bit. Thus, it is intended to ,include, for example, engagement of the formation by any cutters or abrasion elements which may be mounted on the part of the gauge being referred to.)

This has led to the suggestion that bit whirl might be reduced by deliberately designing the bit so that it is imbalanced, and providing a low friction pad on the bit body for engaging the surface of the formation in the region towards which the resultant lateral force due to the imbalance is directed. Anti-whirl bits of this type are described, for example, in U.S. Pat. No. 4,982,802.

However, there may be circumstances during operation of such a drill bit when the lateral imbalance force is, temporarily, not directed towards the low friction pad. In the case where the lateral force is generated by the engagement between the cutting elements and the formation, for example, the direction of the force may change when the weight-on-bit is reduced or when the bit is lifted off the bottom of the hole while still rotating. In such circumstances the resultant lateral imbalance force, although reduced in magnitude, may be directed towards a region of the gauge of the bit away from the low friction pad or pads, and where cutters are mounted. The engagement of such cutters with the formation may then be sufficient to initiate bit whirl, which may persist after the bit re-engages the bottom of the hole.

Such temporary re-direction of the imbalance force may also occur as a result of vibration while drilling, or as a result of the bit, or some of the cutters, striking harder occlusions in the formation, or as a result of temporary variation in the hydraulic forces acting on the bit. In each case there is a risk of bit whirl being initiated.

It is an object of the invention to inhibit the initiation of bit whirl, in such circumstances, by using secondary elements to limit the extent to which certain cutters on the bit body may cut into the surrounding formation, thereby limiting the "frictional" engagement of those cutters with the formation.

It is also known, in drill bits of the kind first referred to, to provide on the rearward side of at least certain of the preform cutting elements, which may be regarded as primary cutting elements, secondary abrasion elements which are set slightly below (or inwardly of) the primary cutting profile defined by the primary cutting elements. Such an arrangement is described, for example, in U.S. patent specification No. 4718505.

(In this specification, the "primary cutting profile" is defined to mean a generally smooth notional surface which is swept out by the cutting edges of the primary cutting elements as the bit rotates without axial movement. The secondary profile is similarly defined as the notional surface swept out by the secondary elements.)

With such an arrangement, during normal operation of the drill bit the major portion of the cutting or abrading action of the bit is performed by the preform primary cutting elements in the normal manner. However, should a primary cutting element wear rapidly or fracture, so as to be rendered ineffective, for example by striking a harder formation, the associated secondary abrasion element takes over the abrading action of the cutting element, thus permitting continued use of the drill bit. Provided the primary cutting element has not fractured or failed completely, it may resume some cutting or abrading action when the drill bit passes once more into softer formation.

The present invention is based on the realization that the provision of secondary cutting elements may also help to reduce or eliminate bit whirl, provided that the secondary cutting elements are located and arranged in an appropriate manner. The invention therefore relates to the appropriate disposition of secondary cutting elements on a drill bit, not only on an anti-whirl bit of the kind referred to above, thereby to improve its inherent anti-whirl characteristics, but also to reduce or eliminate the tendency to whirl of other drill bits which are otherwise of more conventional design.

SUMMARY OF THE INVENTION

According to the invention there, is provided a rotary drill bit comprising a bit body having a shank for connection to a drill string and a passage for supplying drilling fluid to the face of the bit, which carries a plurality of primary cutting elements defining a primary cutting profile, at least some of the primary cutting elements each comprising a preform cutting element having a superhard front cutting face, the bit including means to apply a resultant lateral force to the bit as it rotates in use, and a portion of the outer periphery of the bit body including at least one low friction bearing means so located as to transmit said resultant lateral force to the part of the formation which the bearing means is for the time being engaging, there being associated with at least certain of said primary cutting elements respective secondary elements spaced inwardly of said primary cutting profile, said portion of the periphery of the bit body where said bearing means are located being substantially free of said secondary elements.

Preferably all, or at least the substantial majority, of said secondary elements are located on the opposite side of a diameter of the drill bit to said bearing means.

In a preferred embodiment each secondary element is spaced rearwardly, with respect to the normal direction of rotation of the bit, from a respective primary cutting element, and is located at substantially the same radial distance from the central longitudinal axis of the bit as its respective associated primary cutting element.

Each secondary element may comprise a stud-like element protruding from the bit body. For example, the stud-like element may be separately formed from the bit body, having one end received and retained Within a socket in the bit body, the other end of the stud-like element protruding from the bit body. Alternatively the stud-like element may be integral with the bit body.

A single body of superhard material, such as natural or synthetic diamond, may be embedded in said projecting end of the stud-like secondary element. In one embodiment the projecting end of the stud-like secondary element is generally frusto-conical in shape, and said single body of superhard material is embedded in the central extremity of said frusto-conical shape.

Alternatively a plurality of bodies of superhard material are embedded in at least the projecting end of said stud-like element. In another embodiment said stud-like secondary element may be formed from tungsten carbide.

Said low friction bearing means may include at least one low friction bearing pad extending around a portion of the periphery of the bit body and being substantially free of cutting elements.

The bit body may include a number of blades extending outwardly away from the central longitudinal axis thereof, each blade carrying a plurality of primary cutting elements disposed side-by-side along the length thereof, said secondary elements being associated with the outermost primary cutting elements on those blades where such secondary elements are provided.

The invention also provides a rotary drill bit comprising a bit body having a shank for connection to a drill string and a passage for supplying drilling fluid to the face of the bit, which carries a plurality of primary cutting elements defining a primary cutting profile, at least some of the primary cutting elements each comprising a preform cutting element having a superhard front cutting face, there being associated with at least certain of said primary cutting elements respective secondary elements each spaced inwardly of said primary cutting profile and rearwardly from its respective associated primary cutting element, with respect to the normal direction of rotation of the drill bit, said inward spacing having a vertical and a radial component, each secondary element being so shaped and located as substantially to compensate for said radial component the inward spacing of the secondary element from the primary profile, whereby outwardly facing surfaces on said primary and secondary elements are at substantially the same radial location in spite associated primary cutting element.

In this specification, for convenience, a direction parallel to the longitudinal central axis of rotation of the drill bit is referred to as the "vertical" direction, and directions at right angles to said axis are referred to as "radial" directions.

In the case where each primary cutting element includes an arcuate operative cutting edge portion, the outline of the outwardly facing surface of its associate secondary element is preferably generally tangential to the outline of the radially outer part of said arcuate cutting edge, as viewed along a circumference of constant radius of the drill bit.

The secondary element may have a projecting end surface of generally frusto-conical shape, and said outwardly facing surface of the secondary element may comprise an upwardly facing portion of said frusto-conical surface.

DETAILED DESCRIPTION OF THE PREFERRED EMBODIMENTS

Figure 1:
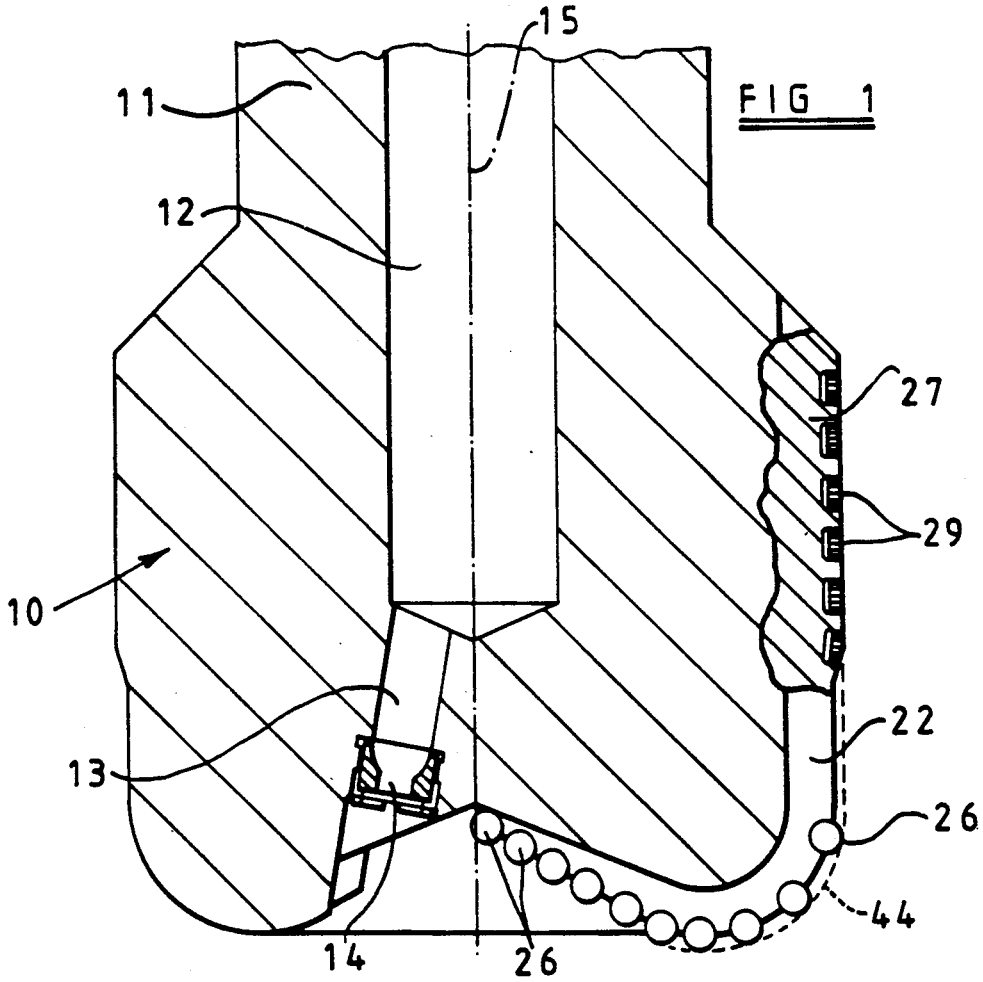
FIG. 1 is a diagrammatic longitudinal section through a PDC drill bit in accordance with the invention.
Figure 2:
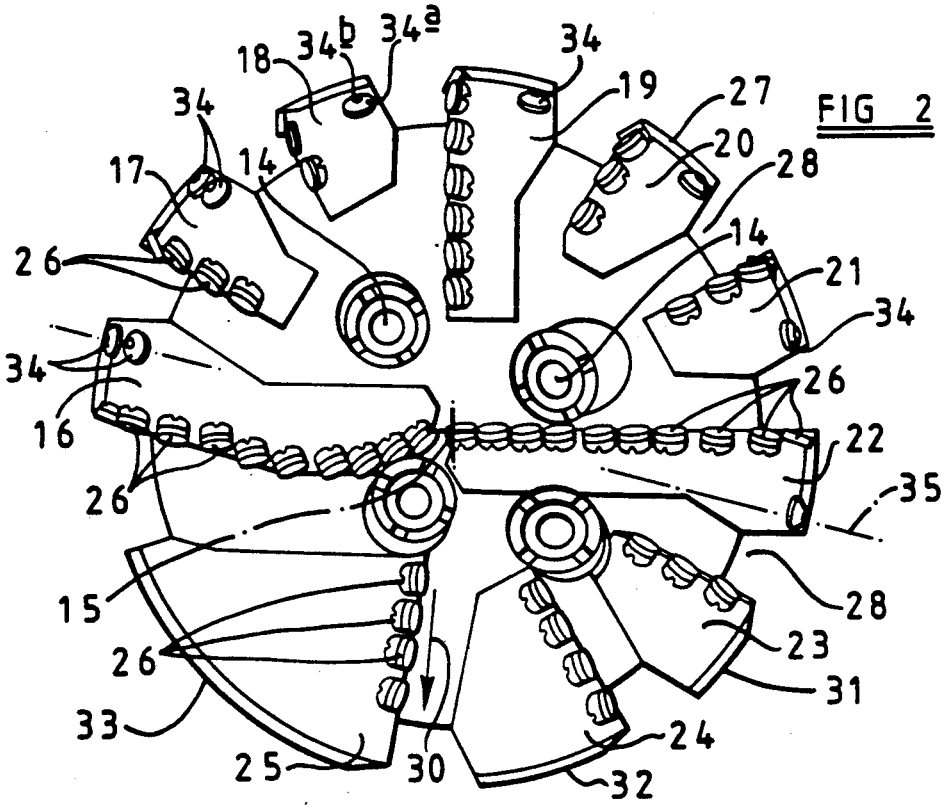
FIG. 2 is an end view of the bit of FIG. 1.

Referring to FIGS. 1 and 2: there is shown a rotary drill bit comprising a bit body 10 having a shank 11 for connection to a drill string, and a central passage 12 for supplying drilling fluid through bores 13 to nozzles 14 in the lower end face of the bit. The central longitudinal axis of rotation of the drill bit is indicated at 15.

The lower end face of the bit is formed with a plurality of upstanding blades 16–25 extending generally outwardly away from the central longitudinal axis 15 of the drill bit. A plurality of primary cutting elements 26 are disposed side by side along the length of each blade. As will be seen from FIG. 2, the blades 16–25 vary in length, and the number of cutting elements carried by each blade varies according to the length of each blade.

Each primary cutting element 26 is of known kind and comprises a two-layer circular tablet comprising a thin front cutting table of polycrystalline diamond bonded to a thicker substrate of cemented tungsten carbide. The cutting element is brazed to a stud-like carrier, which may also be formed from tungsten carbide, which is received and secured within a socket in the respective blade. The design and construction of such cutting structures is well known and will not be described in greater detail.

The bit body 10 has a gauge portion which comprises kickers 27 which form upward extensions of the blades 16–25, and bear against the surface of the formation defining the walls of the borehole being drilled, the kickers being separated by junk slots as indicated at 28. The kickers corresponding to the blades 16–22 have mounted therein abrasion elements 29, the outer surfaces of which are substantially flush with the surface of the kicker.

The drill bit shown in FIGS. 1 and 2 is imbalanced, i.e. it is so designed that when the bit is being run there is a resultant lateral force acting sideways on the bit which, during drilling, is balanced by an equal and opposite reactive force from the walls of the borehole. The direction of the lateral component of the resultant imbalance force is indicated generally by the arrow 30 in FIG. 2.

It will be apparent to those skilled in the art that there are known a number of ways in which the necessary resultant imbalance force can be achieved, and the particular means for achieving this force does not form a part of the present invention. In the exemplary embodiment shown, the fact that more cutters 26 are located on one side of diameter 35 than on the other side causes such imbalance force 30. For further example, the bit may be imbalanced by appropriate selection of the position and rake of the cutting elements, by centrifugal imbalance of the bit body, by control of the lateral components of the hydraulic forces acting on the bit as a result of the flow of drilling fluid through the nozzles 14, or a combination of these and other factors.

In accordance with the previously mentioned concept of reducing bit whirl, the gauge portion of the bit body is provided with low friction bearing means to transmit the imbalance force 30 to the formation. In the arrangement shown in FIGS. 1 and 2 the bearing means comprises low friction bearing surfaces 31, 32 and 33 on the kickers corresponding to the blades 23, 24 and 25 respectively. These kickers preferably each provide a smooth hard bearing surface and in some arrangements, such as shown in FIGS. 1 and 2, they may not include abrasion elements 29 of the kind mounted in the other kickers. However, the invention does not exclude arrangements in which abrasion elements are provided in the low friction bearing surfaces. It will be noted that on the blades 23, 24 and 25 the cutting elements 26 do not extend to the outer extremities of the blades and all lie within a certain radius, so as to reduce the "frictional" contact between these parts of the drill bit and the formation.

Such a drill bit as so far described will have a reduced tendency to whirl and is regarded as an "anti-whirl" bit in accordance with the known art. In accordance with the present invention, however, the anti-whirl characteristics of the bit are further enhanced by the provision of suitably arranged secondary cutting elements.

As previously mentioned, it is known in drill bits of the basic kind to which the invention relates, to provide secondary elements, usually abrasion elements, on the rearward side of at least certain of the primary preform cutting elements. Such secondary elements are usually set slightly below (or inwardly of) the primary cutting profile defined by the primary cutting elements (as hereinbefore defined). Each secondary element may be associated with a respective primary cutting element and disposed rearwardly with respect to the normal direction of rotation of the drill bit.

In the drill bit according to the invention shown in FIGS. 1 and 2, such secondary elements 34 are associated with the outermost one or two primary cutting elements on the blades 16–22, but no such secondary elements are provided on the blades 23–25. Thus, it will be seen that substantially all of the secondary elements 34 are located on the opposite side of a diameter 35 of the drill bit to the low friction bearings 31, 32, 33. Preferably at least the substantial majority of the secondary elements are located on the opposite side of a diameter of the drill bit to the bearing means, but the invention does not exclude arrangements in which a few secondary elements are on the same side of the diameter of the drill bit as the bearing means. Indeed, it may be seen from FIG. 2 that the secondary elements 34 on the blades 16 and 22 lie at approximately the ends of the diameter 35.

As previously explained, such secondary elements are normally considered as providing a backup for the primary cutting elements when such elements are subjected to wear or failure. However, it has been found that, in accordance with the present invention, the secondary elements serve to limit the extent to which the primary cutting elements 26 nearer the gauge portion of the drill bit may cut into the formation. The secondary elements therefore limit the "frictional" engagement between the outer primary cutting elements and the formation and thus further tend to inhibit the initiation of bit whirl, in addition to the anti-whirl function provided by the bit imbalance and provision of low friction bearing means in the direction of the lateral bit imbalance.

The secondary elements 34 may be of any suitable form. In the arrangement shown in FIGS. 1 and 2, each secondary element 34 comprises a generally cylindrical stud of cemented tungsten carbide received and retained within a socket in bit body and having a generally frusto-conical portion 34*a* projecting from the bit body. At the summit of the frustoconical portion there is embedded in the tungsten carbide carrier a body 34*b* of superhard material, such as natural or synthetic diamond.

In an alternative arrangement the secondary element may comprise a plurality of smaller bodies of superhard material embedded in the carrier. Alternatively, the secondary elements may each simply comprise studs of cemented tungsten carbide received in sockets in the bit body and provided with projecting portions of generally frusto-conical shape. Although the studs are preferably separately formed and received and retained in sockets in the bit body, they might also be simple projections integrally formed with the bit body. The latter alternatives are disclosed in greater detail in U.S. Pat. No. 4,718,505 and U.S. Pat. No. 4,889,017, both of which are hereby expressly incorporated herein by reference.

Another suitable form of stud may be of the kind known as PDC buttons, as used controller-cone drill bits. Such studs or buttons have a generally domed head to which is applied an outer layer of polycrystalline diamond, beneath which are usually provided a number of transition layers of less hard material.

Figure 3:
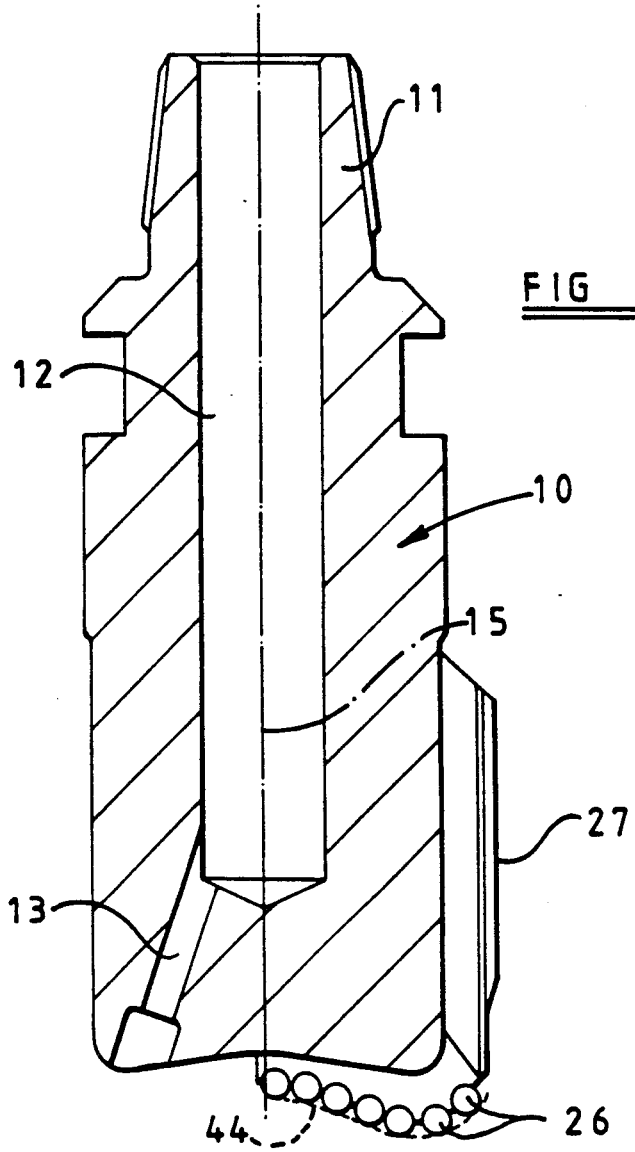
FIG. 3 is a diagrammatic longitudinal section through an alternative form of drill bit.
Figure 4:
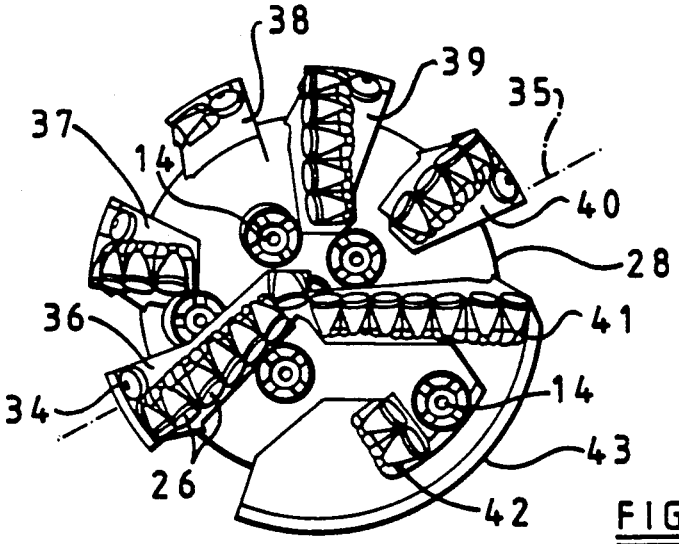
FIG. 4 is an end view of the drill bit shown in FIG. 3.

FIGS. 3 and 4 show an alternative form of drill bit in accordance with the present invention and parts corresponding to parts of FIGS. 1 and 2 are given the same reference numerals.

The arrangement of FIGS. 3 and 4 differs from that of FIGS. 1 and 2 in that only seven blades, numbered 36 through 42, are provided and the kickers associated with the blades 41 and 42 are combined to provide a signal continuous low friction peripheral bearing surface 43. It will be seen that the blades 41 and 42 are free of secondary elements and that the majority of the secondary elements 34 lie on the opposite side of the diameter 35 to the bearing surface 43.

A portion of the primary cutting profile defined by the primary cutting elements 26 is shown in phantom at 44 in FIGS. 1 and 3–6. As previously mentioned, the secondary elements 34 are set slightly inwardly with respect to the primary cutting profile 44. This is shown diagrammatically in FIG. 5 where an exemplary primary cutting element on the outer part of one of the blades is indicated at 26 and the respective secondary abrasion element is indicated at 34.

The primary cutting profile 44, as previously explained, is a generally smooth notional surface which is swept out by the cutting edges of the primary cutting elements 26 as the bit rotates without axial movement. The line 44 is tangential to the peripheries of the cutting elements 26, since the surface which it represents is defined by the path through which the outermost parts of the cutting edges of the primary cutters sweep during rotation of the drill bit. The arrow A in FIG. 5 lies on a radial line and points toward the axis of the bit. It should be noted that an arcuate portion of the peripheral cutting edge of element 26 including its point P of tangency to profile 44, is operative under normal drilling conditions. The radially inner part of this arc is directed mainly vertically downwardly, while the radially outer part has a significantly lateral direction.

Figure 5:
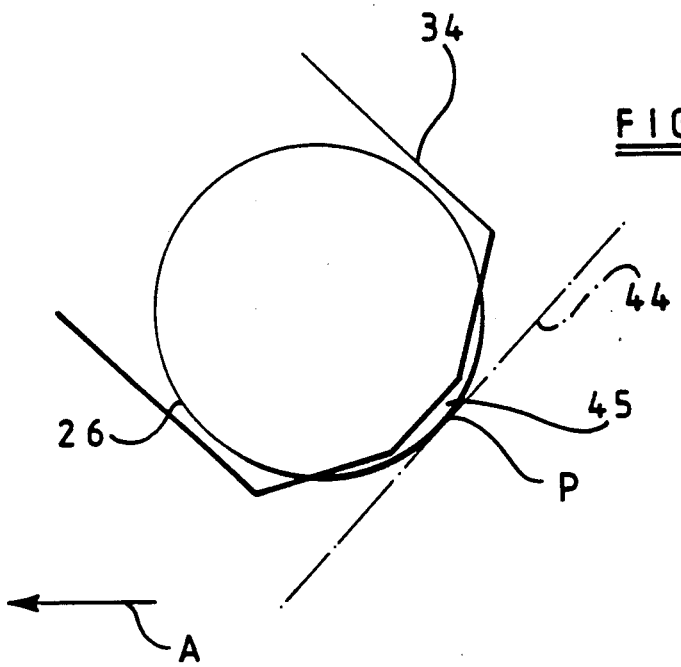
FIG. 5 is a diagrammatic representation showing the relative positions of a primary cutting element and associated secondary element in a drill bit.

The inward spacing of the secondary element from the surface 44 is indicated at 45 and may, for example, be of the order of 0.5 mm. The spacing 45 has both vertical and radial components. The normal practice is that the center of each secondary element 34 is disposed at substantially the same radius from the central longitudinal axis 15 of the drill bit as that of its associated primary cutting element 26, and FIG. 5 shows such an arrangement. It will be seen that, in this case, the secondary element 34 is symmetrically disposed with respect to the primary element 26. Such arrangement may be employed in the embodiments of the invention shown in FIGS. 1 to 4.

Figure 6:
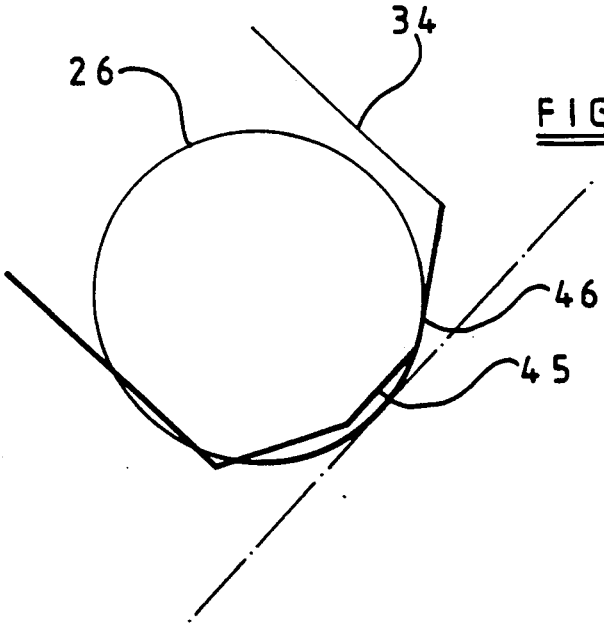
FIG. 6 is a similar representation showing a preferred novel arrangement in accordance with the present invention.

Preferably, however, the associated primary and secondary elements are disposed as shown diagrammatically in FIG. 6. In this case the secondary element 34 is located at a very slightly greater radial distance from the central longitudinal axis 15 of the drill bit than its associated primary cutting element 26. As will be seen from FIG. 6 the extra radial distance is so selected as substantially to compensate for the inward radial displacement of the secondary element caused by the radial component of the inset 45, the vertical component of such inset remaining the same. This has the effect that radially outer parts of the formation-engaging surfaces of the elements 26 and 34 are at substantially the same radial location, as indicated at 46 in FIG. 6, in spite of the inward spacing of the element 34 with respect to its associated primary element 26. More specifically, the secondary element 34 has a generally outer portion of its frustoconical surface 34*a* aligned with the radially outer part of the operative cutting edge portion of the primary cutting element 26 at 46.

It will be appreciated that a similar effect may be achieved by suitable shaping of the secondary element. Thus, instead of (or in addition to) adjusting the radial position of the secondary element, the element itself may be so shaped that when inset from the primary cutting profile an outer part of its formation engaging surface is at substantially the same radial location as an outer part of the operative cutting edge portion of the primary element. Thus, for example, in the arrangement of Figure 5 the diameter of the stud 34 may be increased, without altering its radial position, so that the profile of the outwardly facing surface of the consequently enlarge frustoconical portion 34*a* becomes tangential to the profile of the outer part of the cutting edge of the cutting element 26.

The effect of these arrangements is that the abrasion element 34 effectively limits the lateral or radial penetration of the primary cutting element 26 into the formation, but provides less limitation to vertical penetration Consequently the "frictional" engagement of the primary cutter 26 with the surrounding wall of the borehole is reduced, due to the secondary element 34 limiting penetration of the cutter in that direction, so that consequently the tendency for the drill bit to "walk" around the borehole in the opposite direction to its rotation is also reduced, thus inhibiting the tendency for bit whirl to be initiated.

The arrangement of FIG. 6 may be employed in the location of the secondary elements 34 in the arrangement of FIGS. 1 to 4 and will, in that case, further enhance the anti-whirl characteristics of those drill bits. However, it will also tend to inhibit the initiation of bit whirl in any drill bit having primary and secondary elements and this aspect of the invention is therefore not limited to use with specifically anti-whirl drill bits of the basic kind shown in FIGS. 1 to 4 or as described earlier in the specification as embodying the "anti-whirl concept".

It will be appreciated that FIGS. 5 and 6 are diagrammatic representations of the relative radial positions of the elements 26 and 34 and do not represent actual sections of a drill bit, since the secondary elements 34 will be circumferentially spaced rearwardly of the primary cutting elements 26 with respect to the normal direction of forward rotation of the drill bit during use. Thus FIGS. 5 and 6 may be regarded as showing the relative positions of the outlines of the outwardly facing surfaces of the elements as viewed along a circumference of constant radius of the drill bit.

I claim:

1. A rotary drill bit comprising a bit body having a shank for connection to a drill string and a passage for supplying drilling fluid to the face of the bit, the bit body having a central longitudinal axis and carrying a plurality of primary cutting elements defining a primary cutting profile, at least some of the primary cutting elements each comprising a preform cutting element having a superhard front cutting face, the bit including means to apply a resultant lateral force to the bit as it rotates in use, and a portion of the outer periphery of the bit body including at least one low friction bearing means so located as to transmit said resultant lateral force to the part of the formation which the bearing means is for the time engaging, there being associated with at least certain of said primary cutting elements respective secondary elements spaced inwardly of said primary cutting profile, each primary cutting element having an operative cutting edge portion, and at least certain of said respective secondary elements each having an outer surface portion located at substantially the same radial distance from the central longitudinal axis of the bit as a radially outer part of the operative cutting edge portion of its respective associated primary cutting element.

2. A rotary drill bit according to claim 1, wherein at least the substantial majority of said secondary element are located on the opposite side of a diameter of the drill bit to said bearing means.

3. A rotary drill bit according to claim 2, wherein substantially all said secondary elements are located on the opposite side of a diameter of the drill bit to said bearing means.

4. A rotary drill bit according to claim 1, wherein each secondary element is spaced rearwardly, with respect to the normal direction of rotation of the bit, from a respective primary cutting element.

5. A rotary drill bit according to claim 1, wherein each secondary element comprises a stud-like element protruding from the bit body.

6. A rotary drill bit according to claim 5 wherein the stud-like element is separately formed from the bit body and has one end received and retained within a socket in the bit body, the other end of the stud-like element protruding from the bit body.

7. A rotary drill bit according to claim 5, wherein the stud-like element is integral with the bit body.

8. A rotary drill bit according to claim 6, wherein a single body of superhard material is embedded in said projecting end of the stud-like secondary element.

9. A rotary drill bit according to claim 8 wherein the projecting end of the stud-like secondary element is generally frusto-conical in shape, and said single body of superhard material imbedded in the central extremity of said frusto-conical shape.

10. A rotary drill bit according to claim 6, wherein a plurality of bodies of superhard material are embedded in at least the projecting end of said stud-like element.

11. A rotary drill bit according to claim 6, wherein said stud-like secondary element is formed from tungsten carbide.

12. A rotary drill bit according to claim 1, wherein said low friction bearing means include at least one low friction bearing pad extending around a portion of the periphery of the bit body and being substantially free of cutting elements.

13. A rotary drill bit according to claim 1, wherein said bit body includes a number of blades extending outwardly away from the central longitudinal axis thereof, each blade carrying a plurality of primary cutting elements disposed side-by-side along the length thereof, said secondary elements being associated with the outermost primary cutting elements on those blades where such secondary elements are provided.

14. A rotary drill bit comprising a bit body having a shank for connection to a drill string and a passage for supplying drilling fluid to the face of the bit, which carries a plurality of primary cutting elements defining a primary cutting profile, at least some of the primary cutting elements each comprising a preform cutting element having a superhard front cutting face, there being associated with at least certain of said primary cutting elements respective secondary elements each spaced inwardly of said primary cutting profile and rearwardly from its respective associated primary cutting element, with respect to the normal direction of rotation of the drill bit, said inward spacing having a vertical and a radial component, each secondary element being s shaped and located as substantially to compensate for said radial component of the inward spacing of the secondary, element from the primary profile, whereby radially outer parts of formation-engaging surfaces on said primary and secondary elements are at substantially the same radial location in spite of the inward spacing of the secondary element from its associated primary cutting element.

15. A rotary drill bit according to claim 14, wherein each primary cutting element includes an arcuate cutting edge and wherein the outline of the outwardly facing surface of its associated secondary element is generally tangential to the outline of said arcuate cutting edge, as viewed along a circumference of constant radius of the drill bit.

16. A rotary drill bit according to claim 15, wherein the secondary element has a projecting end surface of generally frusto-conical shape, and wherein said outwardly facing surface of the secondary element comprises an outwardly facing portion of said frusto-conical surface.

* * * * *